US006014539A

United States Patent [19]

Sano et al.

[11] Patent Number: 6,014,539

[45] Date of Patent: Jan. 11, 2000

[54] IMAGE HEATING DEVICE

[75] Inventors: Tetsuya Sano, Numazu; Hiroki Kisu, Fujisawa; Hideo Nanataki, Tokyo; Atsuyoshi Abe, Susono, all of Japan

[73] Assignee: Canon Kabushiki Kaisha, Tokyo, Japan

[21] Appl. No.: 08/832,278

[22] Filed: Apr. 3, 1997

[30] Foreign Application Priority Data

| | | | |
|---|---|---|---|
| Apr. 5, 1996 | [JP] | Japan | 8-108664 |
| May 31, 1996 | [JP] | Japan | 8-138167 |
| Mar. 21, 1997 | [JP] | Japan | 9-068151 |
| Mar. 21, 1997 | [JP] | Japan | 9-068152 |

[51] Int. Cl.[7] ..... G03G 15/20

[52] U.S. Cl. ..... 399/329; 219/216; 219/619; 399/328

[58] Field of Search ..... 399/328, 329, 399/330, 333; 219/216, 619, 671, 469, 470; 492/25, 46, 47; 226/171, 186, 190

[56] References Cited

U.S. PATENT DOCUMENTS

| | | | |
|---|---|---|---|
| 3,012,141 | 12/1961 | Thomiszer | 399/162 X |
| 4,001,544 | 1/1977 | Heinzer et al. | 219/216 |
| 4,134,667 | 1/1979 | Schnall et al. | 492/47 |
| 4,386,839 | 6/1983 | Kumagai et al. | 399/116 |
| 5,191,381 | 3/1993 | Yuan | 399/90 |
| 5,393,959 | 2/1995 | Kitano et al. | 219/619 |
| 5,525,775 | 6/1996 | Setoriyama et al. . | |
| 5,526,103 | 6/1996 | Kato et al. | 399/328 |
| 5,552,582 | 9/1996 | Abe et al. | 219/619 |
| 5,568,240 | 10/1996 | Ohtsuka . | |
| 5,819,150 | 10/1998 | Hayasaki et al. | 399/330 |

FOREIGN PATENT DOCUMENTS

| | | |
|---|---|---|
| 62-150371 | 7/1987 | Japan . |
| 4-044080 | 2/1992 | Japan . |
| 4-261569 | 9/1992 | Japan . |
| 4-360181 | 12/1992 | Japan . |
| 5-9027 | 1/1993 | Japan . |
| 5-208750 | 8/1993 | Japan . |
| 6-266254 | 9/1994 | Japan . |
| 6-314043 | 11/1994 | Japan . |
| 6-345292 | 12/1994 | Japan . |
| 9-054509 | 2/1997 | Japan . |

*Primary Examiner*—Matthew S. Smith
*Attorney, Agent, or Firm*—Fitzpatrick, Cella, Harper & Scinto

[57] ABSTRACT

An image heating device includes a protective member for protecting an end portion of an endless film. The protective member has a hardness which is lower than that of the film. Hence, even if the film and the protective member rub each other, the damage of the end portion of the film can be prevented, and excellent image heating can be performed.

53 Claims, 13 Drawing Sheets

IMAGE HEATING DEVICE

BACKGROUND OF THE INVENTION

1. Field of the Invention

This invention relates to an image heating device applied to an image forming apparatus, such as a copier, a printer or the like, and more particularly, to a device for heating an image utilizing a film.

2. Description of the Related Art

Conventionally, heat-roller-type fixing devices have been widely used as image heating devices represented by heating fixing devices. In such apparatuses, a tungsten halogen lamp is heated by passing current therethrough to heat a toner image via a roller.

Accordingly, there is some distance between a heating position and a toner, and therefore the efficiency of consumed energy is reduced.

In order to solve such a problem, image heating devices, such as one disclosed in U.S. Pat. No. 5,525,775, in which a heater is made in contact with a film to heat a toner image by the heat from the heater via the film, have been proposed, and an attempt to improve the thermal efficiency has been made.

Furthermore, as disclosed in Japanese Examined Patent Publication No. 5-9027 (1993) (Japanese Unexamined Patent Publication No. 62-150371), a heating device in which eddy currents are generated in a fixing roller by a magnetic flux to heat the fixing roller by Joule heat has been proposed. In this proposal, by making a heating position close to a toner by utilizing the generation of eddy currents, an attempt to improve the efficiency of consumed energy has been made.

In order to further improve the thermal efficiency, a fixing device in which a film itself or a conductive member provided in the vicinity of a film is heated by generating eddy currents therein to heat the film has been proposed.

In such film-type fixing devices, however, even if it is intended to increase the speed or the durability of the device, the film shifts in a direction orthogonal to the moving direction. If the amount of shift is large, an end portion of the film and the side plate of the fixing device rub each other, thereby damaging the end portion of the film in the longitudinal direction.

Particularly in image heating devices utilizing electromagnetic induction, since the film has a conductive (metallic) layer, a burr is produced at the end portion of the film, thereby causing crease or crack in the film and damaging the film.

SUMMARY OF THE INVENTION

It is an object of the present invention to provide an image heating device in which the damage of an end portion of a film is prevented.

It it another object of the present invention to provide an image heating device in which the hardness of a protective member for protecting an end portion of a film is lower than the hardness of the film.

It is still another object of the present invention to provide an image heating device in which an elastic member is provided between a protective member for protecting an end portion of a film and the film.

It is yet another object of the present invention to provide an image heating device in which an adhesive member is provided between a protective member for protecting an end portion of a film and the film.

It is yet a further object of the present invention to provide an image heating device in which a protective member is provided at an end portion of a film heated by a magnetic flux generated by magnetic-flux generation means.

According to one aspect, the present invention which achieves these objectives relates to an image heating device including an endless film for moving together with a recording material bearing an image while contacting the recording material, a regulating member for regulating a shift of the film in a direction orthogonal to a moving direction of the film, and a protective member for protecting an end portion of the film in the direction orthogonal to the moving direction of the film. The protective member has a hardness which is lower than that of the film.

According to another aspect, the present invention which achieves these objectives relates to an image heating device including an endless film for moving together with a recording material bearing an image while contacting the recording material, a regulating member for regulating a shift of the film in a direction orthogonal to a moving direction of the film, a protective member for protecting an end portion of the film in the direction orthogonal to the moving direction of the film, and an elastic member provided between the film and the protective member.

According to still another aspect, the present invention which achieves these objectives relates to an image heating device including an endless film for moving together with a recording material bearing an image while contacting the recording material, a regulating member for regulating a shift of the film in a direction orthogonal to a moving direction of the film, a protective member for protecting an end portion of the film in the direction orthogonal to the moving direction of the film, and an adhesive member provided between the film and the protective member.

According to yet another aspect, the present invention which achieves these objectives relates to an image heating device including a rotating endless film having a conductive layer, and a magnetic-flux generation unit for generating a magnetic flux. Eddy currents are generated in the film by the magnetic flux generated by the magnetic-flux generation unit. The film is heated by the eddy currents to heat an image on a recording material. The device also includes a regulating member for regulating a shift of the film in a direction orthogonal to a moving direction of the film, and a protective member for protecting an end portion of the film in the direction orthogonal to the moving direction of the film.

The foregoing and other objects, advantages and features of the present invention will become more apparent from the following detailed description of the preferred embodiments taken in conjunction with the accompanying drawings.

BRIEF DESCRIPTION OF THE DRAWINGS

FIG. 12(*b*) is a cross-sectional view of a fixing film shown in FIG. 12(*a*)

DETAILED DESCRIPTION OF THE PREFERRED EMBODIMENTS

Preferred embodiments of the present invention will now be described in detail with reference to the drawings.

Figure 4A:
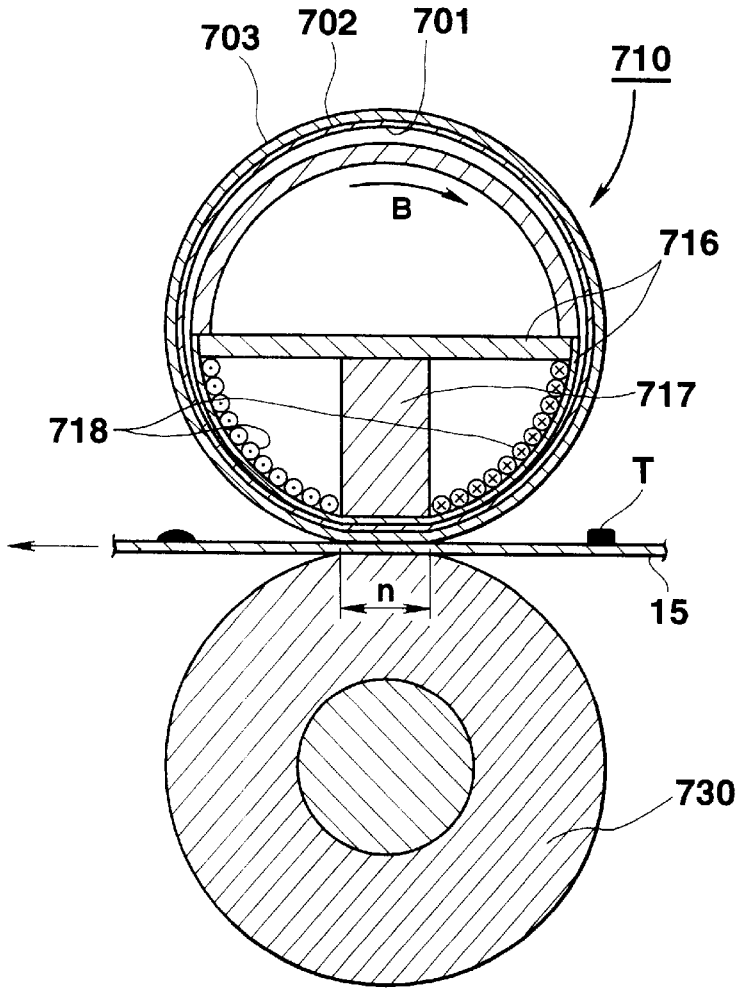
FIG. 4(A) is a cross-sectional view of the image heating device of the invention.
Figure 4B:
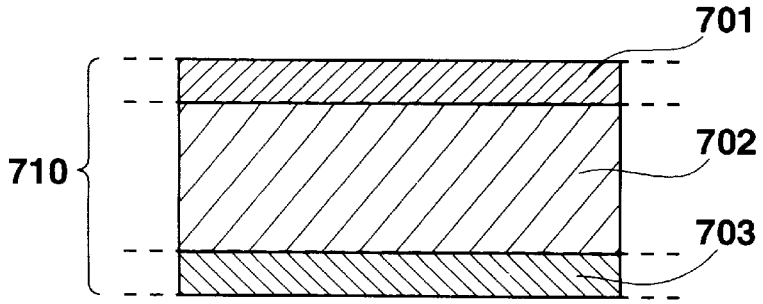
FIG. 4(B) is a cross-sectional view of a fixing film shown in FIG. 4(A)
Figure 5:
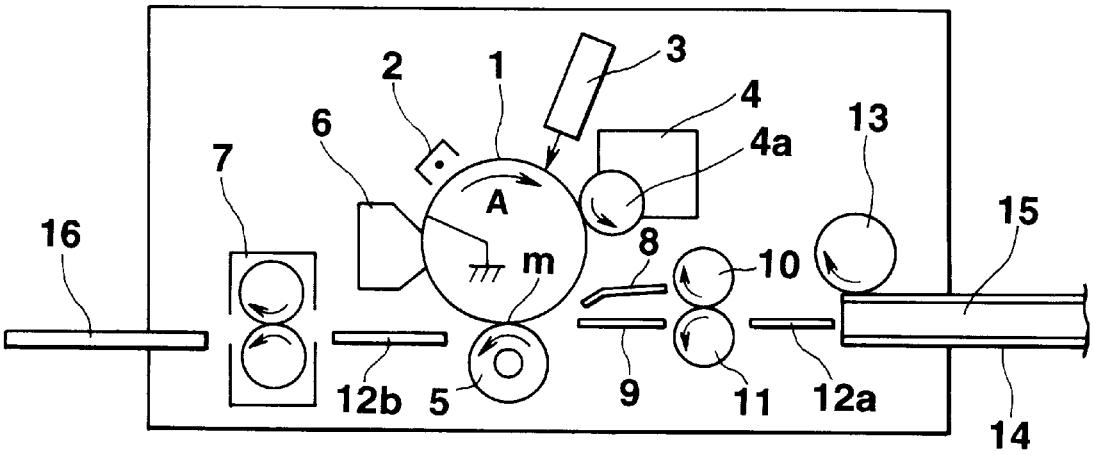
FIG. 5 is a cross-sectional view illustrating an image forming apparatus which uses the image heating device of the invention.

First, a description will be provided of a first embodiment of the present invention with reference to FIGS. 1, 4(A), 4(B) and 5. FIG. 5 is a cross-sectional view illustrating an image forming apparatus which uses an image heating device of the invention. In FIG. 5, a rotating-drum-type electrophotographic photosensitive member (hereinafter termed a "photosensitive drum") serves as an image bearing member. The photosensitive drum 1 is rotatably driven in a clockwise direction indicated by an arrow A at a predetermined circumferential speed (process speed), and is uniformly charged to a predetermined negative dark potential $V_D$ by a primary charger 2 while being rotated.

A laser-beam scanner 3 outputs a laser beam modulated in accordance with a time-serial electric digital image signal representing target image information input from a host apparatus (not shown), such as an image reading apparatus, a word processor, a computer or the like. By the scanning exposure of the surface of the photosensitive drum 1, uniformly charged by the primary charger 2, by the laser beam, the absolute value of the potential of exposed portions decreases to assume a light potential $V_L$. Thus, an electrostatic latent image corresponding to the target image information is formed on the surface of the rotating photosensitive drum 1.

The latent image is then subjected to reverse development by toner particles negatively charged by a developing unit 4 to provide a toner image (i.e., the toner particles adhere to the portions exposed by the laser beam).

The developing unit 4 has a rotatably-driven developing sleeve 4*a*. A thin toner layer having negative charges is coated on the outer circumference of the developing sleeve 4*a* so as to face the surface of the photosensitive drum 1. A developing bias voltage $V_{DC}$ whose absolute value is smaller than the dark potential $V_D$ and larger than the light potential $V_L$ of the photosensitive drum 1 is applied to the developing sleeve 4*a*. Hence, the toner particles on the developing sleeve 4*a* are transferred only onto portions having the light potential $V_L$ to visualize the latent image (reversal development).

Sheets of a recording material 15, serving as a material to be heated, mounted on a sheet feeding tray 14 are individually fed by being driven by a sheet feeding roller 13. Each of the fed sheets of the recording material 15 is fed to a nip portion (transfer portion) m between the photosensitive drum 1 and a transfer roller 5, serving as a transfer member, which contacts the photosensitive drum 1 and to which a transfer bias voltage is applied, via a feeding guide 12*a*, a pair of registration rollers 10 and 11, and transfer guides 8 and 9 at an appropriate timing in synchronization with the rotation of the photosensitive drum 1, and the toner image on the surface of the photosensitive drum 1 is sequentially transferred onto the surface of the recording material 15. The resistivity of the transfer roller 5 is preferably about $10^8$–$10^9$ Ωcm.

The recording material 15 passing through the transfer portion m is separated from the surface of the photosensitive drum 1, and is guided to a fixing device 7 by a conveyance guide 12*b*. The transferred toner image on the recording material 15 is fixed by the fixing device 7, and the recording material 15 is discharged onto a discharged-sheet tray 16 as an image bearing member (a print). Residues, such as toner particles remaining after image transfer, and the like, on the surface of the photosensitive drum 1 after the separation of the recording material 15 are removed by a cleaning device 6, so that the photosensitive drum 1 is repeatedly used for image formation.

Next, the fixing device, serving as the image heating device of the first embodiment, will be described in detail. First, a description will be provided of the entire configuration of the fixing device. FIG. 4(A) is a cross-sectional view of the fixing device of the first embodiment. In FIG. 4(A), a fixing film 710, serving as a rotating member, rotates in the direction of an arrow B. A film guide 716 presses the fixing film 710 against a pressing portion (hereinafter termed a "nip portion") n and stabilizes the conveyance of the fixing film 710.

As illustrated in the cross-sectional view of FIG. 4(B), the fixing film 710 comprises an elastic layer 702 made of rubber or the like provided on a heat generating layer 701 made of a conductive material, and a releasing layer 703, provided on the elastic layer 702, for preventing offset.

The heat generating layer 701 is preferably composed of a ferromagnetic metal such as nickel, iron, ferromagnetic stainless steel or the nickel-cobalt alloy and has a thickness within a range of 1 to 100 μm.

The elastic layer 702 is composed of a material with satisfactory heat resistance and thermal conductivity, such as silicone rubber, fluororubber or fluorosilicone rubber and has a thickness of 10 to 500 μm.

The releasing layer 703 is composed of a material with satisfactory releasing performance and heat resistance, such as fluororesin (PFA, PTFE, FEP etc.), silicone resin, fluorosilicone rubber, fluororubber or silicone rubber and has a thickness within a range of 1 to 100 μm.

By generating eddy currents on the heat generating layer 701 of the fixing film 710 by a core 717 having a high permeability and a coil 718, which constitute magnetic-flux generation means, supported on the film guide 716, the heat generating layer 701 is heated to heat a toner T on the recording material 15 at the nip portion n.

A material to be used for the core of a transformer, such as ferrite, permalloy or the like, more preferably, ferrite having little loss even at frequencies higher than 100 kHz, is used for the high-permeability core 717. A magnetic flux is generated by passing a high-frequency current having a frequency of 20 kHz–500 kHz from an exciting circuit (not shown) through the coil 718 wound around the core 717. Eddy currents are generated in the heat generating layer 701 due to changes in the magnetic flux to cause heating by Joule heat determined by the specific resistance of the heating layer 701.

A pressing roller 730, serving as a pressing member or a backup member, is disposed so as to be in pressure contact with the film guide 716 via the fixing film 710 having the above-described configuration. The unfixed toner T on the recording material 15, serving as a material to be heated, is heated and fixed by passing the recording material 15 through the nip portion n formed between the pressing roller 730 and the fixing film 710.

The heat generated in the heat generating layer 701 of the fixing film 710 in the above-described manner is transmitted to the nip portion n via the elastic layer 702 and the releasing layer 703 to heat the recording material 15 conveyed through the nip portion n in a state of being grasped therein and the toner T on the recording material 15. Hence, the toner T within the nip portion n melts and is then fixed by being cooled after passing through the nip portion n to provide a permanent fixed image.

However, when using the film in the above-described manner, in some cases, an end portion of the film and a side plate of the fixing device rub each other, thereby damaging the end portion of the film.

Figure 1:
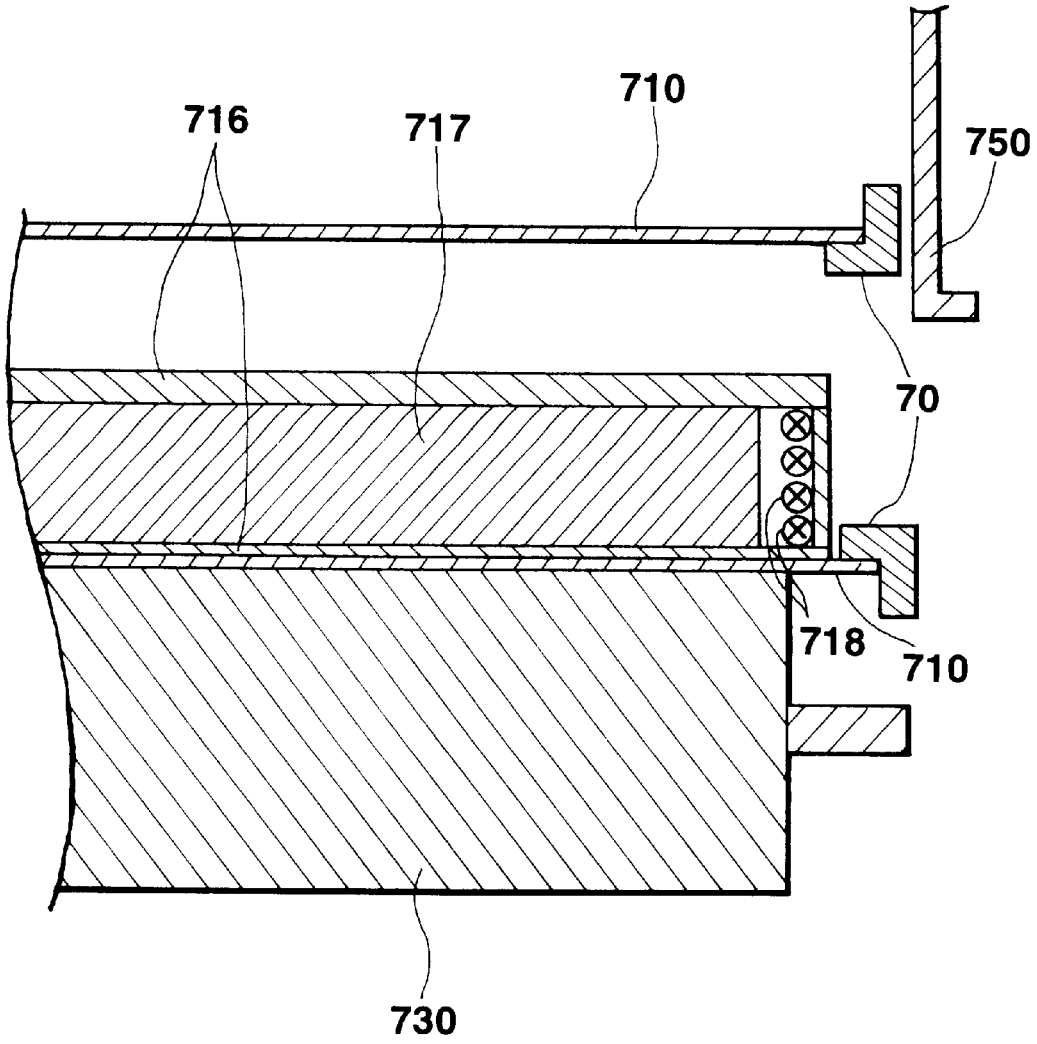
FIG. 1 is a cross-sectional view illustrating an end portion of an image heating device according to a first embodiment of the present invention.

Accordingly, the first embodiment has a configuration as shown in FIG. 1. FIG. 1 is a cross-sectional view illustrating an end portion in the longitudinal direction (a direction orthogonal to the moving direction of the fixing film) of the fixing device in which features of the first embodiment can be clearly shown. In FIG. 1, reference numeral 70 represents a cap, serving as a protective member, about 2 mm thick provided so as to cover the end portion in the longitudinal direction of the fixing film 710. The cap 70 is rotated together with the fixing film 710. The first embodiment has features in that electroformed Ni and a Polyoxymethylene (POM) material are used for the fixing film 710 and the cap 70, respectively, and that the value of hardness of the cap 70 is lower than the values of hardness of the fixing film 710 and a side plate 750, serving as a regulating member for regulating the shift of the fixing film 710. The cap 70 has the shape of a ring.

The cap 70 is preferably composed of heat-resistant resin such as phenol resin, polyimide resin, polyamide resin, polyamide-imide resin, PEEK resin, PES resin, PPS resin, fluororesin (PFA resin, PTFE resin, FEP resin, etc.), LCP (liquid crystal polymer) resin and mixed resin which is mixed with several said resin, and has a thickness within a range from 0.5 to 3 mm.

For example, the values of hardness according to JIS (Japanese Industrial Standards) Handbook/Plastics measured by a Barcol hardness tester were HBI-A70 and HBI-A40 for the electroformed Ni film and the POM cap, respectively.

By thus using a member having a value of hardness lower than the values of hardness of the fixing film 710 and the side plate 750 as the cap 70, it is possible to prevent the damage of the end portion of the fixing film 710 even when intending to increase the speed and the durability of the device.

That is, when the cap 70 is not provided, the end portion of the fixing film 710 directly contacts the side plate 750. As a result, when intending to increase the speed and durability of the device, the end portion of the fixing film 710 is degraded and damaged, and therefore a desired performance is not obtained. On the other hand, when using the cap 70 having a value of hardness smaller than the values of hardness of the fixing film 710 and the side plate 750 at the end portion of the fixing film 710, the damage of the end portion of the fixing film 710 is prevented by the presence of the cap 70 which is gradually scraped off, so that a high-speed and high-durability device can be realized.

Particularly, since the fixing film 710 of the first embodiment has a metal layer made of electroformed Ni, the cap 70 is mainly scraped off. Hence, it is possible to prevent the occurrence of burr in the end portion of the fixing film 710, and therefore to prevent the damage of the fixing film 710.

Furthermore, by using this cap 70, it is possible to hold the fixing film 710 by merely bringing it in contact with the end of one of the side plates 750, and therefore to simplify the configuration of the device.

Figure 2:
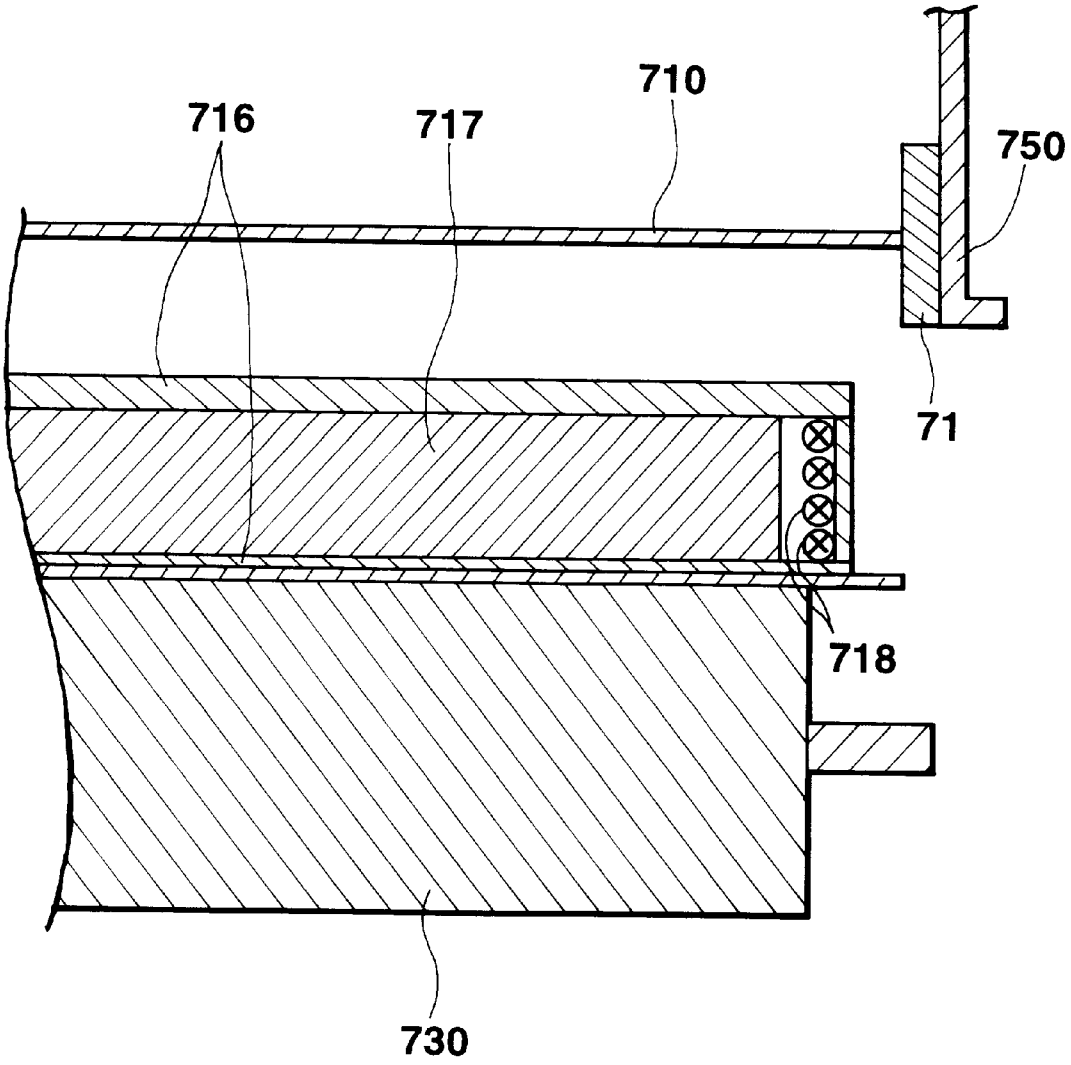
FIG. 2 is a cross-sectional view illustrating an end portion of an image heating device according to a second embodiment of the present invention.

Next, a description will be provided of a second embodiment of the present invention with reference to FIG. 2. In the second embodiment, the cap 70 provided at the end portion in the longitudinal direction of the fixing film 710 in the first embodiment is omitted, and a plate-like member 71 having a value of hardness smaller than that of the fixing film 710 is provided at the inner side (a side contacting the end portion of the fixing film 710 ) of the side plate 750. The member 71 is preferably composed of heat-resistant resin such as phenol resin, polyimide resin, polyamide resin, polyamide-imide resin, PEEK resin, PES resin, PPS resin, fluororesin (PFA resin, PTFE resin, FEP resin, etc.), LCP resin and mixed resin which is mixed with several of said resins. According to such a configuration, the damage of the end portion of the fixing film 710 can be prevented. Table 1 illustrates the results of durability tests when using the member 71 of the second embodiment, when not using the member 71, and when using a member 72 having a value of hardness larger than the value of hardness of the fixing film 710 instead of the member 71.

TABLE 1

| Number of sheets (thousands) | 50 | 100 | 150 | 200 | 250 | 300 | 350 |
|---|---|---|---|---|---|---|---|
| Member 71 | ND | ND | ND | ND | ND | ND | ND |
| No member | ND | ND | ND | ND | D | D | D |
| Member 72 | ND | ND | ND | ND | D | D | D |

D: The end portion of the fixing film 710 damaged
ND: The end portion of the fixing film 710 not damaged As can be understood from Table 1, when not using a member and when using the member 72, the damage of the end portion of the fixing film 710 occurs at the number of sheets of 200 thousands and 250 thousands, respectively. However, when using the member 71, the fixing film 710 can be used in a state of no damage of the end portion thereof until the number of sheets of 300 thousands which is considered to be the minimum number for the fixing device of the image forming apparatus.

Furthermore, since an accuracy required for being fitted on the fixing film 710 as a cap is unnecessary for the member 71, the second embodiment is advantageous for providing a low-cost device.

The same effects may be obtained even if a member similar to the member 71 is used as the side plate 750.

Figure 3:
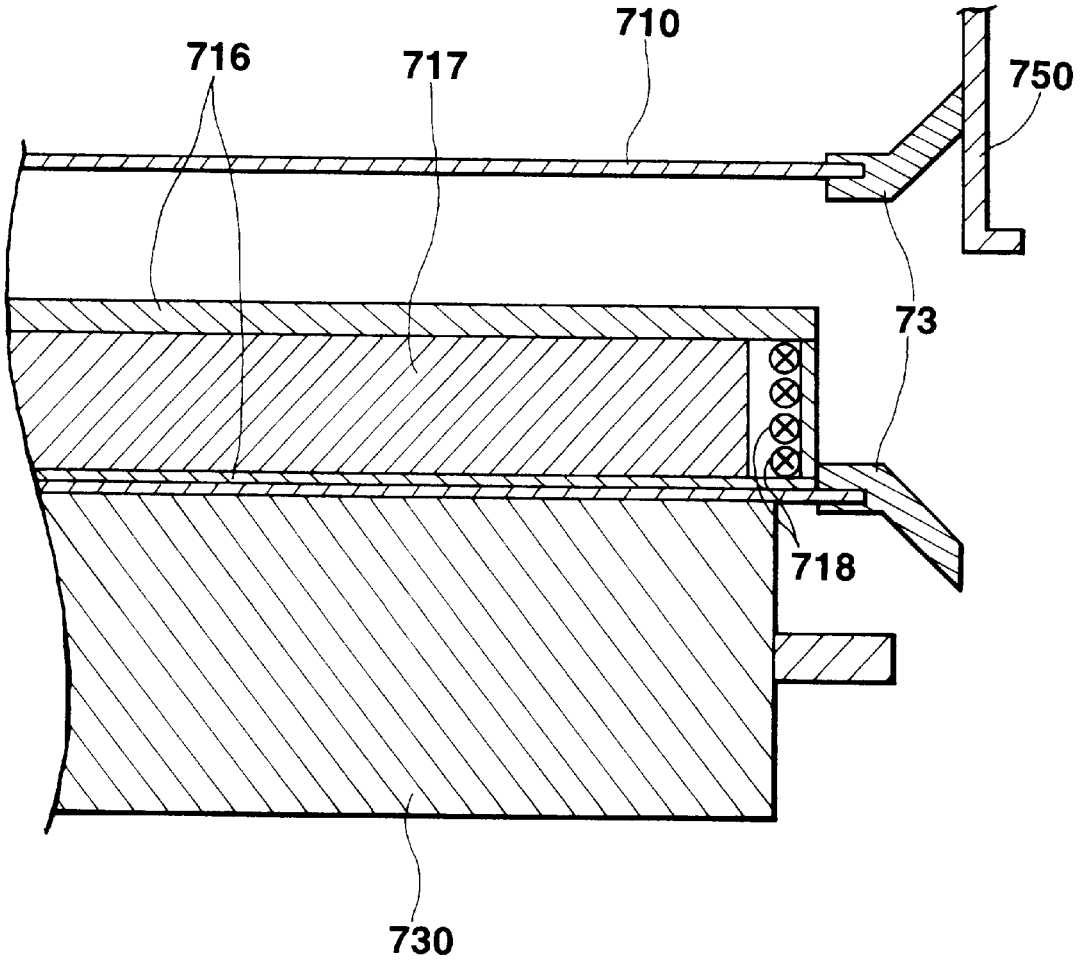
FIG. 3 is a cross-sectional view illustrating an end portion of an image heating device according to a third embodiment of the present invention.

Next, a description will be provided of a third embodiment of the present invention with reference to FIG. 3. The third embodiment has the same configuration as the first embodiment except that a cap 73 is used instead of the cap 71 used in the first embodiment. As in the first embodiment, the cap 73 has a value of hardness smaller than the values of hardness of the fixing film 710 and the side plate 750. As can be understood from FIG. 3, the cap 73 has a feature in that its portion contacting the side plate 750 is designed to be oblique relative to the side plate 750. That is, the cap 73 has a conical shape so that the diameter increases toward the side plate 750. According to this configuration, it is possible not only to prevent the damage of the end portion of the fixing film 710, but also to reduce the torque because the contact area between the cap 73 and the side plate 750 is small. Since the cap 73 is gradually scraped off during the use, the contact position between the side plate 750 and the cap 73 moves. Accordingly, the portion of the side plate 750 contacting the cap 73 changes, and therefore the degradation of the side plate 750 can be reduced. It is also possible to provide warning about the life of the device from the movement of the contact position due to the scraped cap 73.

Next, a description will be provided of embodiments of the present invention for mitigating strain in a film and preventing the damage of an end portion of the film.

Figure 12A:
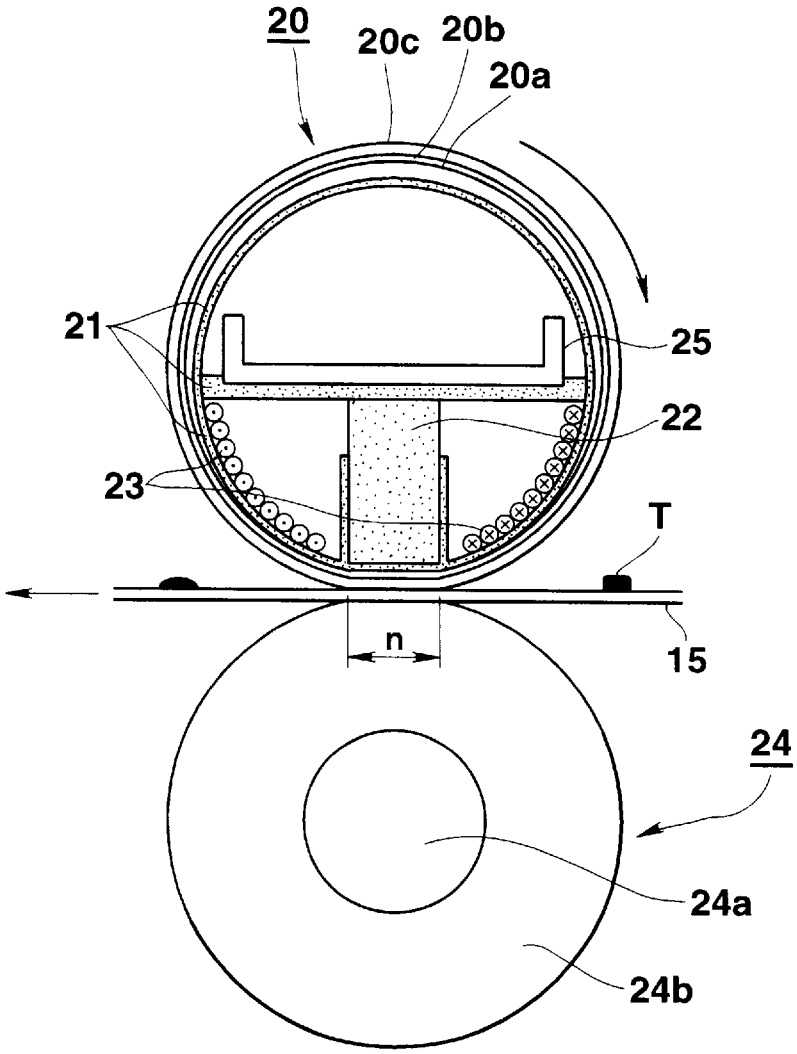
FIG. 12(*a*) is a cross-sectional view of the image heating device of the invention.
Figure 12B:
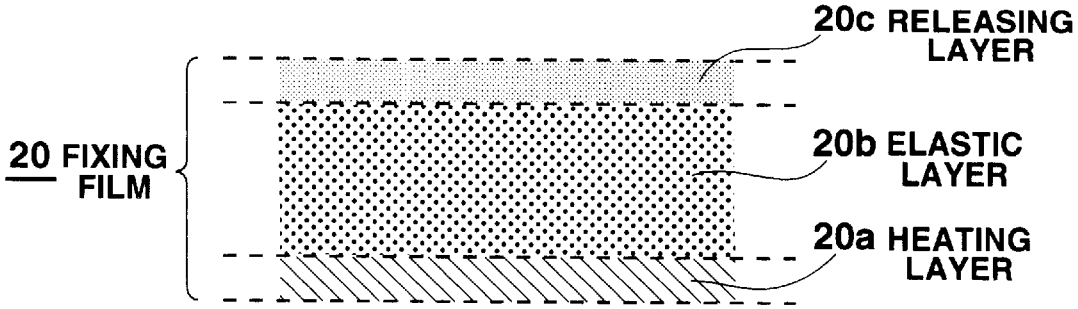
Figure 13:
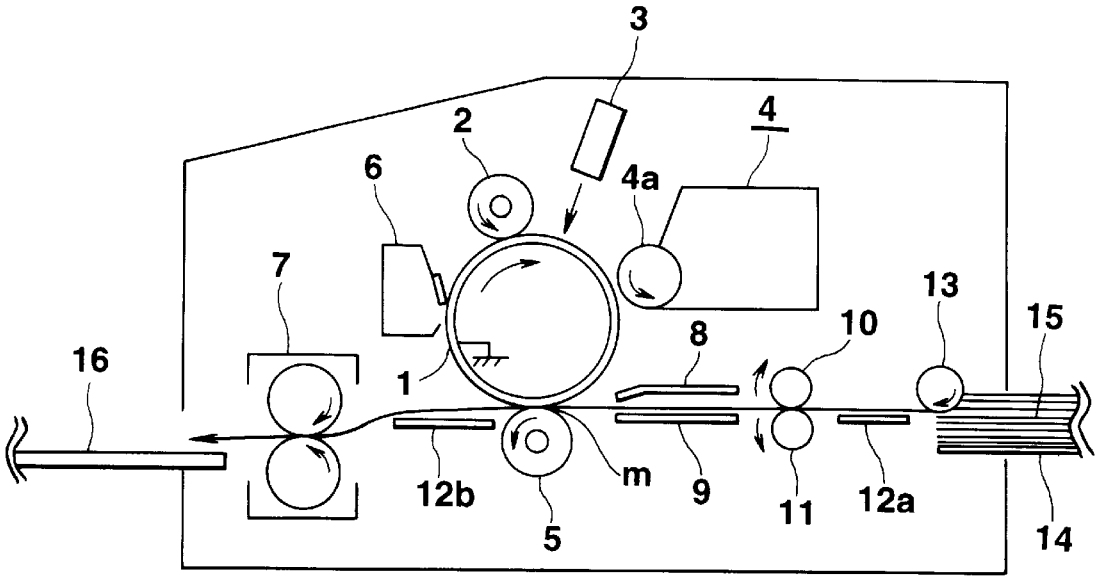
FIG. 13 is a cross-sectional view illustrating an image forming apparatus which uses the image heating device of the invention.

FIG. 12 is a cross-sectional view illustrating an image forming apparatus which uses an image heating device of the invention as a fixing device.

In FIG. 5, a rotating-drum-type electrophotographic photosensitive member (hereinafter termed a "photosensitive drum") serves as an image bearing member. The photosensitive drum 1 is rotatably driven in a clockwise direction indicated by an arrow at a predetermined circumferential speed (process speed), and is uniformly charged to a predetermined negative dark potential $V_D$ by a primary charger (charging roller) 2 while being rotated.

A laser-beam scanner 3 outputs a laser beam modulated in accordance with a time-serial electric digital image signal representing target image information input from a host apparatus (not shown), such as an image reading apparatus, a word processor, a computer or the like. By the scanning exposure of the surface of the photosensitive drum 1, uniformly charged by the primary charger 2, by the laser beam, the absolute value of the potential of exposed portions decreases to assume a light potential $V_L$. Thus, an electrostatic latent image corresponding to the target image information is formed on the surface of the rotating photosensitive drum 1.

The latent image is then subjected to reverse development by toner particles negatively charged by a developing unit 4 to provide a toner image (i.e., the toner particles adhere to the portions exposed by the laser beam).

The developing unit 4 has a rotatably-driven developing sleeve 4*a*. A thin toner layer having negative charges is coated on the outer circumference of the developing sleeve 4*a* so as to face the surface of the photosensitive drum 1. A developing bias voltage $V_{DC}$ whose absolute value is smaller than the dark potential $V_D$ and larger than the light potential $V_L$ of the photosensitive drum 1 is applied to the developing sleeve 4*a*. Hence, the toner particles on the developing sleeve 4*a* are transferred only onto portions having the light potential $V_L$ to visualize the latent image (reversal development).

Sheets of a recording material 15 mounted on a sheet feeding tray 14 are individually fed by being driven by a sheet feeding roller 13. Each of the fed sheets of the recording material 15 is fed to a nip portion (transfer portion) m between the photosensitive drum 1 and a transfer roller 5, serving as a transfer member, which contacts the photosensitive drum 1 and to which a transfer bias voltage is applied, via a feeding guide 12*a*, a pair of registration rollers 10 and 11, and transfer guides 8 and 9 at an appropriate timing in synchronization with the rotation of the photosensitive drum 1, and the toner image on the surface of the photosensitive drum 1 is sequentially transferred onto the surface of the recording material 15. The resistivity of the transfer roller 5 is preferably about $10^8$–$10^9$ Ωcm.

The recording material 15 passing through the transfer portion m is separated from the surface of the photosensitive drum 1, and is guided to a fixing device 7, serving as an image heating device, by a conveyance guide 12*b*. The transferred toner image on the recording material 15 is fixed by the fixing device 7, and the recording material 15 is discharged onto a discharged-sheet tray 16 as an image bearing member (a print). Residues, such as toner particles remaining after image transfer, and the like, on the surface of the photosensitive drum 1 after the separation of the recording material 15 are removed by a cleaning device 6, so that the photosensitive drum 1 is repeatedly used for image formation.

Next, the fixing device, serving as the image heating device of the invention, will be described in detail.

First, a description will be provided of the entire configuration of the fixing device.

FIG. 12(*a*) is a cross-sectional view of the fixing device of the invention.

In FIG. 12(*a*), an endless fixing film 20, serving as a rotating member, rotates in the direction of an arrow. A film guide 21 presses the fixing film 20 against a pressing portion (hereinafter termed a "nip portion") n and stabilizes the conveyance of the fixing film 20. As illustrated in the cross-sectional view of FIG. 12(*b*), the fixing film 20 comprises an elastic layer 20*b* made of rubber or the like provided on a heating layer 20*a* made of a conductive material, and a releasing layer 20*c* provided on the elastic layer 20*b* for improving separability from the toner. By generating eddy currents on the heating layer 20*a* of the fixing film 20 by a core 22 having a high permeability and an exciting coil 23 supported on the film guide 21, the heating layer 20*a* is heated to heat an unfixed toner T on the recording material 15 at the nip portion n.

A material to be used for the core of a transformer, such as ferrite, permalloy or the like, more preferably, ferrite having little loss even at frequencies higher than 100 kHz, is used for the high-permeability core 22. A magnetic flux is generated by passing a high-frequency current having a frequency of 20 kHz–500 kHz from an exciting circuit (not shown) through the coil 23 wound around the core 22. Eddy currents are generated in the heating layer 20*a* due to changes in the magnetic flux to cause heating by Joule heat determined by the specific resistance of the heating layer 20*a*.

A pressing roller 24, comprising a core 24*a* and a silicone-rubber layer 24*b*, which serves as a pressing member, is disposed so as to be in pressure contact with the fixing film 20 having the above-described configuration. The unfixed toner T on the recording material 15, serving as a material to be heated, is heated and fixed by passing the recording material 15 through the nip portion n formed between the pressing roller 24 and the fixing film 20.

The heat generated in the heating layer 20*a* of the fixing film 20 in the above-described manner is transmitted to the nip portion n via the elastic layer 20*b* and the releasing layer 20*c* to heat the recording material 15 conveyed through the nip portion n in a state of being grasped therein and the toner T on the recording material 15. Hence, the toner T within the nip portion n melts and is then fixed by being cooled after passing through the nip portion n to provide a permanent fixed image.

Figure 6:
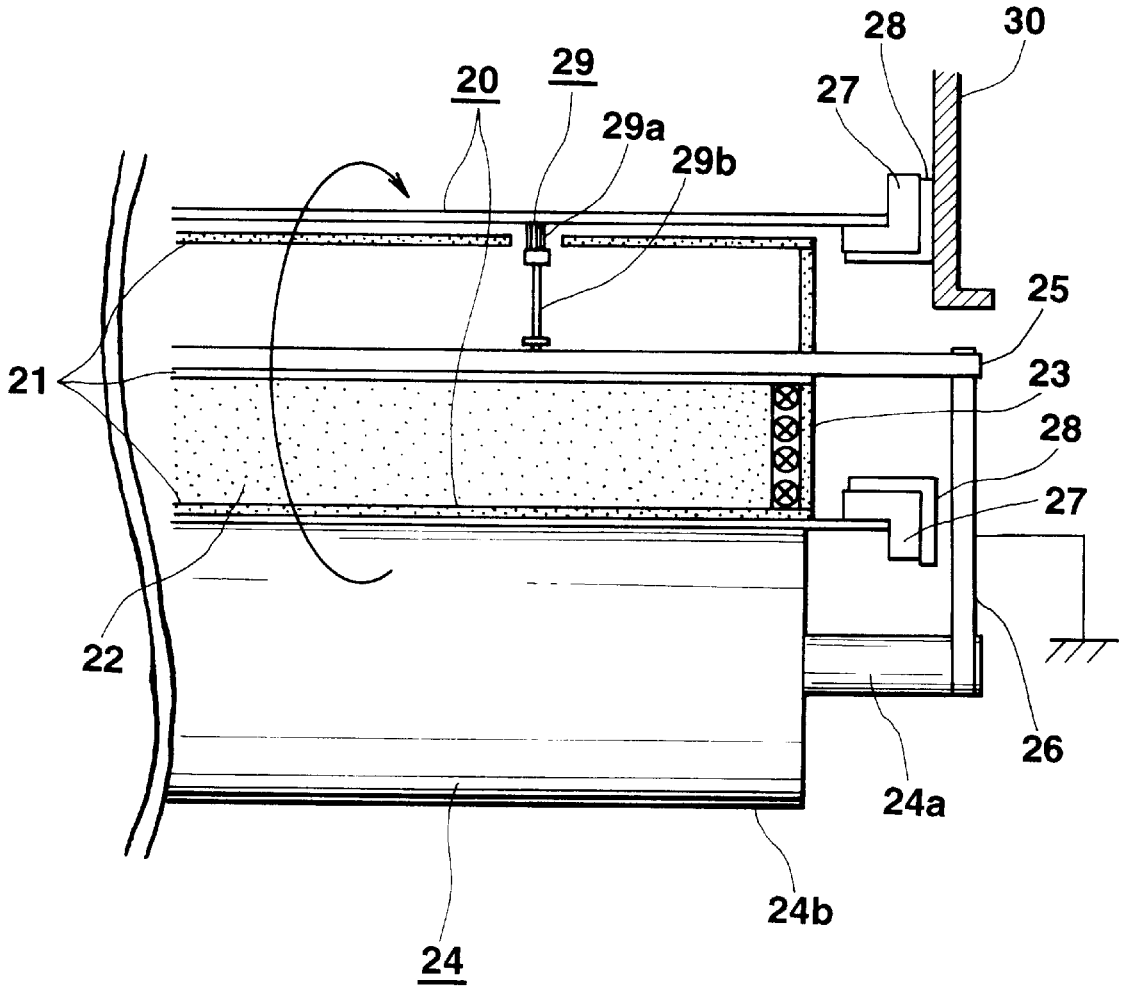
FIG. 6 is a cross-sectional view illustrating an end portion of an image heating device according to a fourth embodiment of the present invention.
Figure 7:
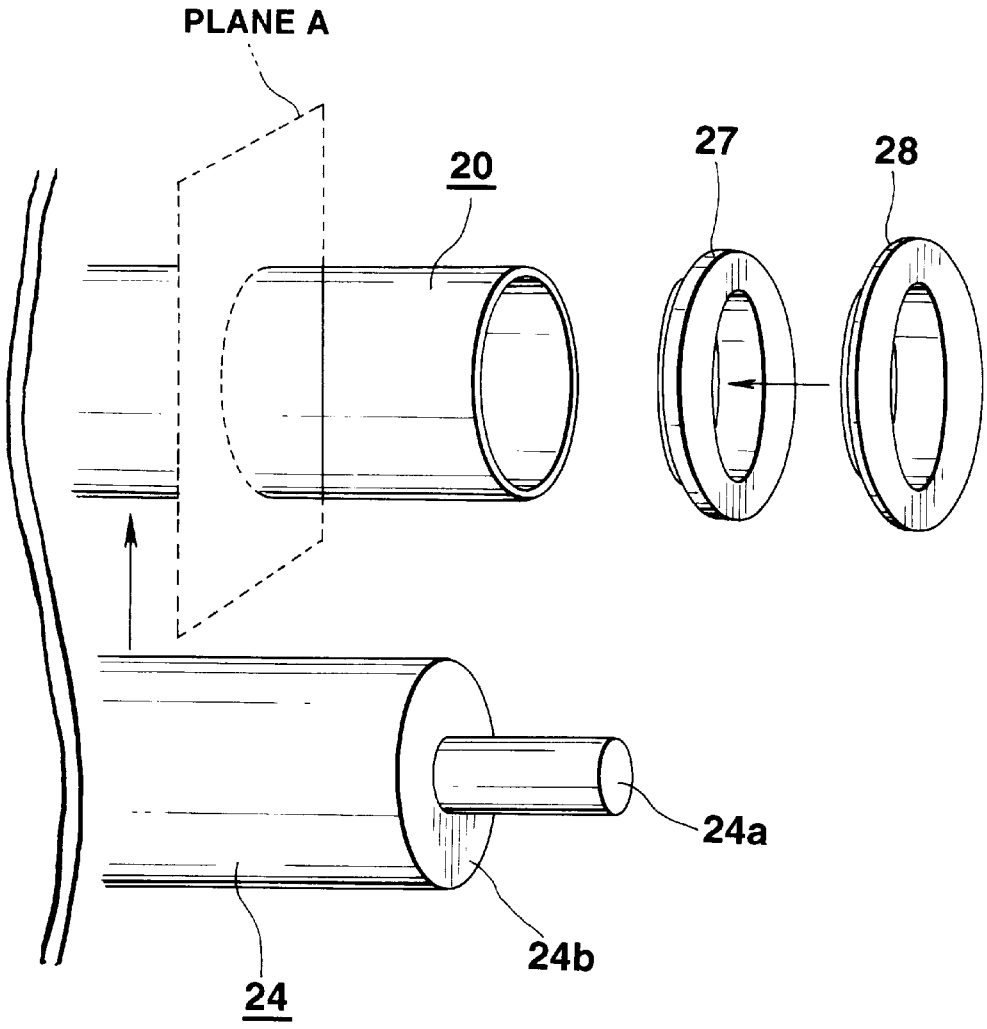
FIG. 7 is an exploded perspective view of the end portion of the image heating device shown in FIG. 6.
Figure 8:
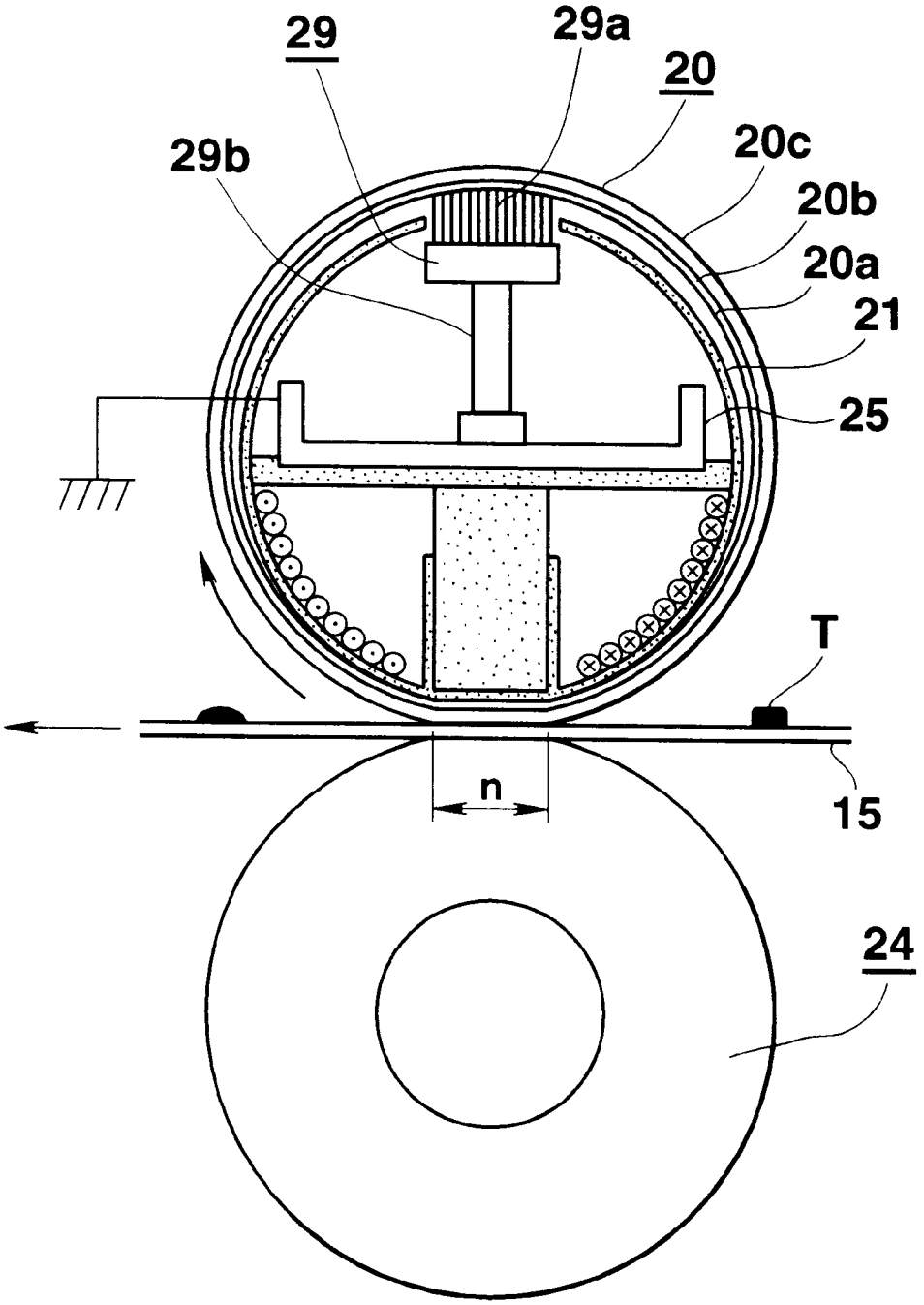
FIG. 8 is a cross-sectional view at a plane A shown in FIG. 7.

A fourth embodiment of the present invention has a configuration as shown in FIGS. 6, 7 and 8. FIG. 6 is a cross-sectional view illustrating an end portion in the longitudinal direction of the fixing device in which features of the fourth embodiment can be clearly seen. FIG. 7 is an exploded perspective view illustrating the end portion in the longitudinal direction of the fixing device shown in FIG. 6. FIG. 8 is a cross-sectional view taken along a plane A shown in FIG. 7.

In FIGS. 6–8, a holding stay 25 made of nonmagnetic stainless steel or the like is provided so as to be threaded through a central portion of a film guide 21 in the longitudinal direction. The holding stay 25 makes a film 20 come in contact with a pressing roller 24 via the film guide 21. By holding the holding stay 25 and a pressing-roller core 24*b* by a conductive pressing member 26, such as a spring or the like, the pressure of the pressing roller 24 against the film 20 is adjusted to a predetermined value. The pressing member 26 is grounded.

A grounding member 29 comprises a conductive brush 29*a* and a nonmagnetic conductive holding member 29*b*. The conductive brush 29*a* is made in contact with a heating layer 20*a* of the film 20, and the nonmagnetic conductive holding member 29*b* is fixed and held on the holding stay 25. The film 20 is connected to the pressing-roller core 24*a* by the member 29 via the holding stay 25 and the conductive pressing member 26 and is therefore grounded. Hence, the film 20 and the pressing roller 24 have the same potential (0 V), and therefore offset can be prevented. That is, even if the film 20 is degraded after the use of a long time period, it is possible to prevent an increase in the surface potential of the fixing film 20 and the pressing roller 24 to produce charges, and to obtain an excellent fixed image in which offset does not occur.

Reference numeral 28 represents a driven ring, serving as a film-end supporting member or a protective member, made of POM, an ABS resin or the like, and reference numeral 27 represents an elastic ring comprising an elastic member made of silicone rubber or the like. As shown in FIG. 7, the elastic ring 27 is fitted to an end portion of the film 20 in a direction orthogonal to the moving direction of the film 20, and the driven ring 28 is made in contact with a regulating plate 30 serving as a regulating member for regulating the shift of the film 20.

The driven ring 28 is pererably composed of heat-resistant resin such as phenol resin, polyimide resin, polyamide resin, polyamide-imide resin, PEEK resin, PES resin, PPS resin, fluororesin (PFA resin, PTFE resin, FEP resin, etc.), LCP resin and mixed resin which is mixed with several of said resins.

According to the above-described configuration, it is possible to reduce the torque of the film 20, and to prevent degradation of the film 20 due to friction between the end portion of the film 20 and the regulating plate 30. Furthermore, since the elastic ring 27 is present, it is possible to absorb the distortion of the film 20 produced at the nip portion n, where the film 20 is pressed by the pressing roller 24, by the elastic ring 27 without directly transmitting the distortion to the driven ring 28 which is rigid, and therefore to mitigate the stress. Accordingly, even when intending to increase the speed or the durability of the device, it is possible to prevent the rupture or damage of the end portion of the film 20 and therefore to mitigate the degradation of the film 20.

Figure 9:
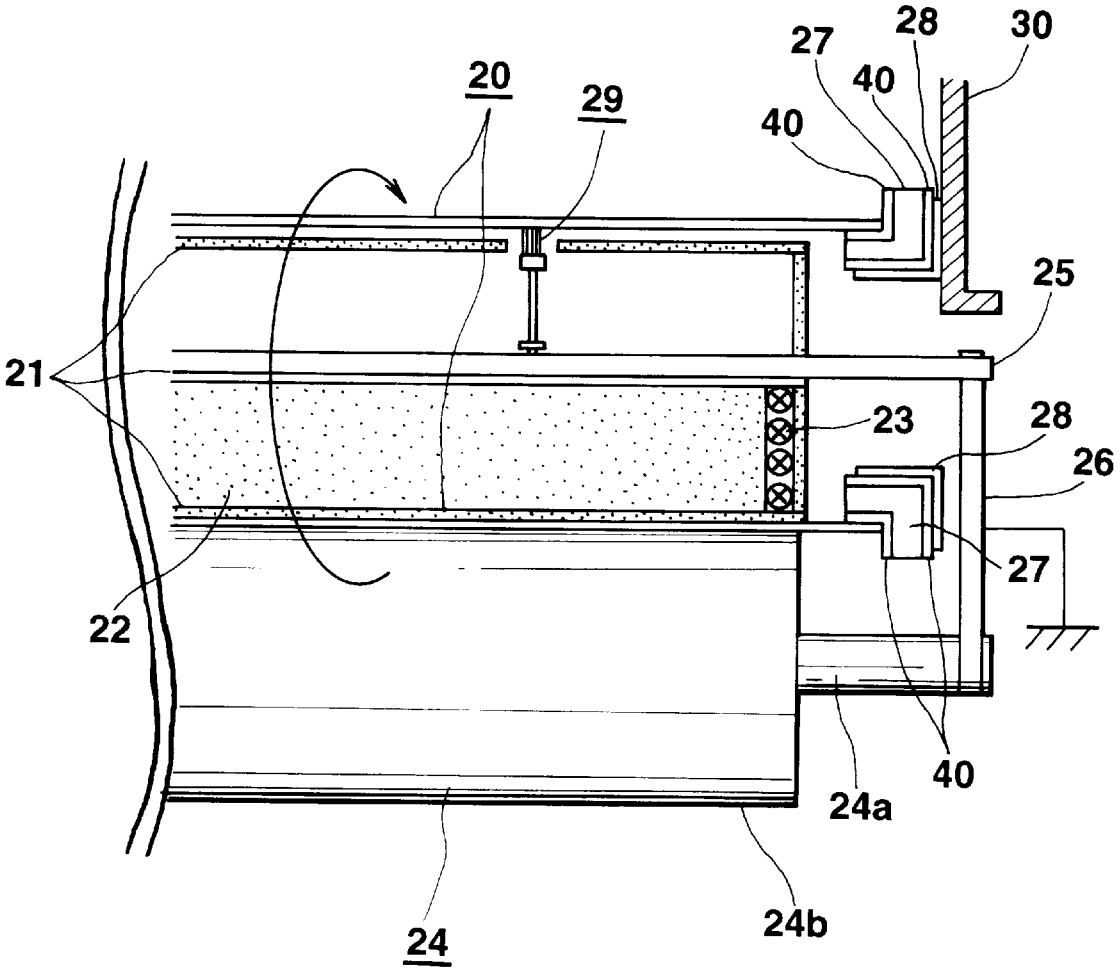
FIG. 9 is a cross-sectional view illustrating an end portion of an image heating device according to a fifth embodiment of the present invention.

FIG. 9 illustrates a fifth embodiment of the present invention.

The fifth embodiment differs from the fourth embodiment in that adhesive layers 40 are provided between the elastic ring 27 and the film 20, and between the elastic ring 27 and the driven ring 28.

The adhesive layers 40 are provided on the surfaces of the elastic ring 27 contacting the film 20 and the driven ring 28 by coating an adhesive, such as a silicone adhesive or the like, so that the film 20 and the elastic ring 27, and the elastic ring 27 and the driven ring 28 adhere to each other and each pair can rotate as one body. According to such a configuration, the film 20, the elastic ring 27 and the driven ring 28 smoothly rotate as one body, and useless rub between the respective members can be prevented. The driven ring 28 and the elastic ring 27 merely adhere to the film 20 and therefore can also independently rotate. Accordingly, when an excessive force is applied due to a jam or the like, the film 20 moves independently of the elastic ring 27 and the driven ring 28, and therefore the damage of the film 20 can be prevented. According to the above-described configuration, it is possible to prevent the application of an excessive force to the end portion of the film, and therefore to prevent the degradation of the end portion of the film and to increase the speed and the durability of the film. In the fifth embodiment, also, it is possible to mitigate the shift of the film by the elastic member and to prevent the damage of the end portion of the film.

Although in the fifth embodiment, the adhesive layer 40 is formed by coating an adhesive only on the elastic ring 27, an adhesive may also be coated on the surface of the driven ring or the film or on the surfaces of both of these members. When the elastic ring and the driven ring adhere well to each other, the adhesive layer between the elastic ring and the driven ring may be omitted, and when the film and the elastic ring adhere well to each other, the adhesive layer between the film and the elastic ring may be omitted. Alternatively, an adhesive elastic member may be used as the elastic ring.

Figure 10:
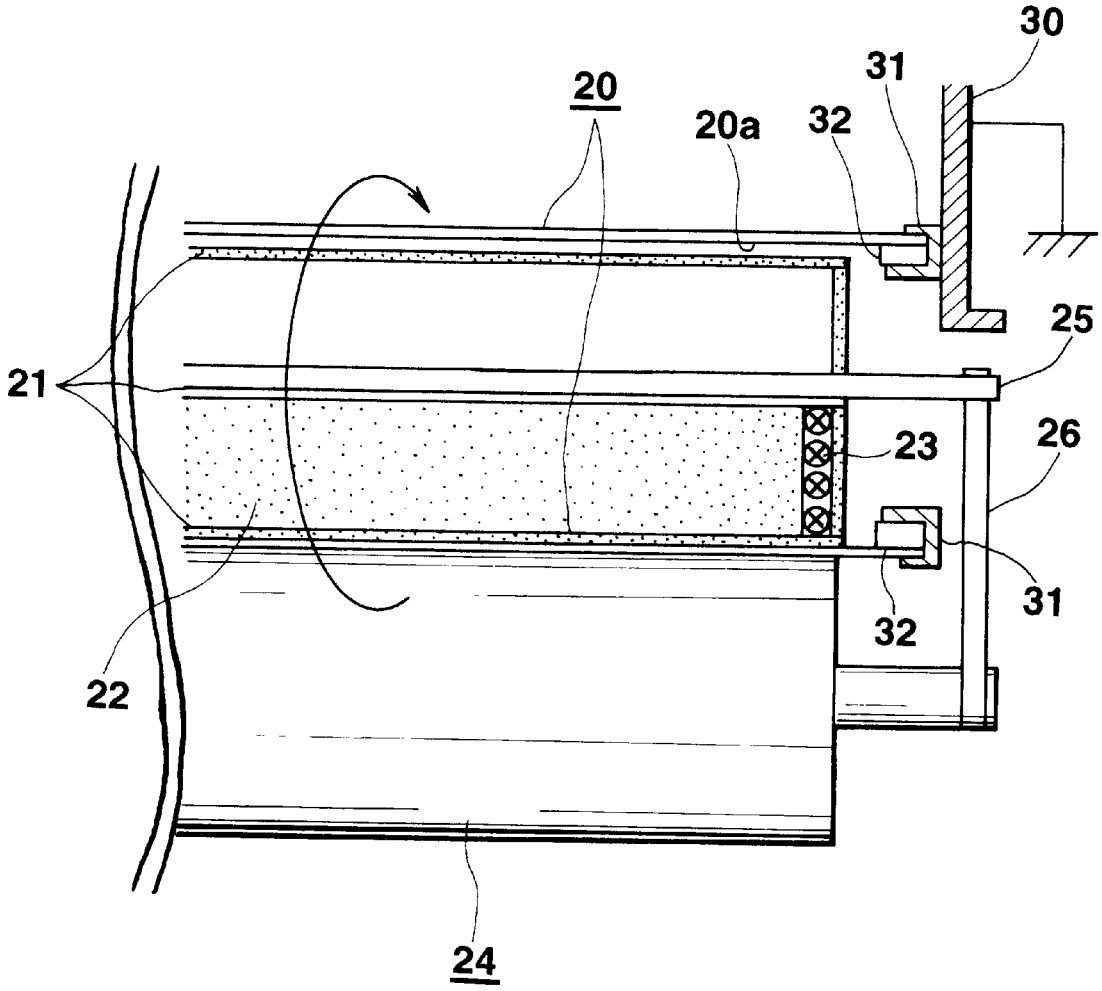
FIG. 10 is a cross-sectional view illustrating an end portion of an image heating device according to a sixth embodiment of the present invention.

FIG. 10 illustrates a sixth embodiment of the present invention.

In FIG. 10, reference numeral 31 represents a driven ring serving as a conductive film supporting member made of polyacetal or the like. The driven ring 31 is bonded to a heating layer 20*a*, which is a conductive layer, of a film 20 by a conductive elastic adhesive 32, and is held so as to contact a conductive regulating plate 30. The driven ring 31 and the elastic adhesive 32 operate as one body with the film 20 and rotate in a state of sliding relative to the surface of the regulating plate 30. Accordingly, there is no useless rub between the film 20 and the driven ring 31, and therefore the degradation of the film 20 can be prevented. For example, a conductive grease or the like is coated between the conductive film supporting member 31 and the regulating plate 30, so that the film 20 is assuredly grounded. Since the film 20 is thus grounded via the conductive elastic adhesive 32, the conductive film supporting member 31 and the regulating plate 30, it is possible to prevent accumulation of charges even under the condition of continuous passage of a large amount of sheets in an environment of a low temperature and a low humidity, and therefore to prevent the generation of offset. Furthermore, since the strain between the film 20 and the driven ring 31 caused by the distortion of the film 20 at the nip portion n is mitigated by using the conductive elastic adhesive 32, the degradation or the damage of the end portion of the film 20 is mitigated, and therefore the speed and the durability of the device can be increased.

According to the configuration in which the conductive driven ring contacts the regulating plate in a state of being bonded to the end portion of the film, the configuration of the device can be simplified.

Figure 11:
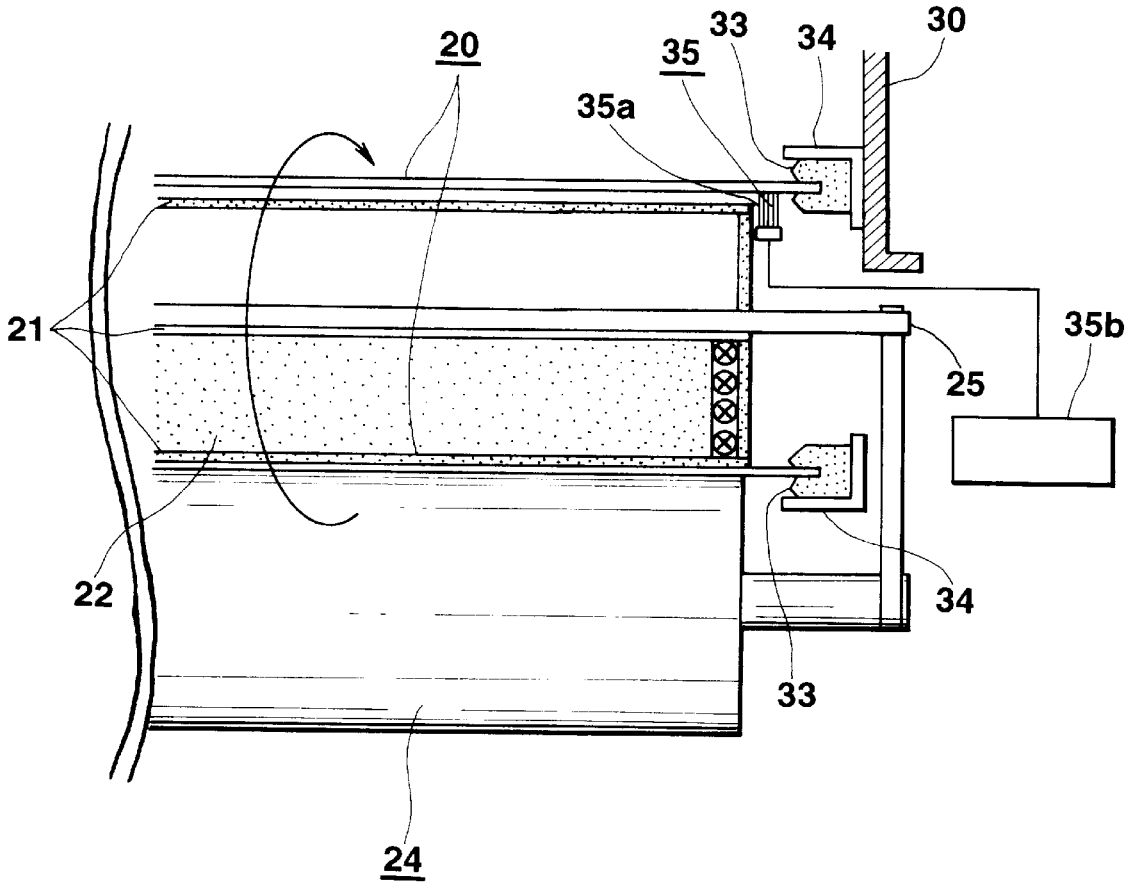
FIG. 11 is a cross-sectional view illustrating an end portion of an image heating device according to a seventh embodiment of the present invention.

FIG. 11 illustrates a seventh embodiment of the present invention.

In FIG. 11, an insulating elastic member 33 made of silicone rubber or the like having a JIS-A hardness of 5°–40° is provided at an end portion of a film so as to grasp the film by an elastic layer 1–3 mm thick by being dipped. An insulating driven ring 34 made of POM, an ABS resin or the like is covered on the film having the elastic member 33 and is held so as to contact a regulating plate 30. A bias-voltage applying member 35 comprises a conductive brush 35*a* contacting a heating layer, which is a conductive layer, of the film, and a power supply 35*b*, which supplies a voltage having the same polarity as the toner.

The driven ring 34 is preferably composed of heat-resistant resin such as phenol resin, polyimide resin, polyamide resin, polyamide-imide resin, PEEK resin, PES resin, PPS resin, fluororesin (PFA resin, PTFE resin, FEP resin, etc.), LCP resin and mixed resin which is mixed with several said resin.

Table 2 illustrates the results of durability tests in which the device is rotated at a high speed (a process speed of 200 mm/sec) without passing sheets therethrough. For the purpose of comparison, the device is rotated without passing sheets therethrough using elastic members having values of hardness of 2° and 50°. In Table 2, the number of revolutions is converted into the number of A4-size passing sheets. When the hardness is 50°, the end portion of the film was damaged at the number of revolutions corresponding to 150 thousand sheets. When the elastic member having the value of hardness of 2° was used, the elastic member itself was degraded at the number of revolutions corresponding to 100 thousand sheets, and the end portion of the film was also ruptured immediately after the degradation. On the other hand, in the seventh embodiment, no degradation and rupture of the end portion of the film ocurred even after the number of revolutions corresponding to 350 thousand sheets.

Table 3 illustrates the result of image evaluation for the fixing device of the seventh embodiment after a durability test in an environment of low temperature and low humidity. A negatively charged toner was used, and a bias voltage of −500 V was applied. For the purpose of comparison, image evaluation was performed when the applied voltage was 0 V (grounded) and the potential of the film was floated. While offset occurred at 150 thousand sheets when the film potential was floated, no offset occurred even at 350 thousand sheets in the seventh embodiment.

Although only the case of application of a bias voltage of −500 V is illustrated, the value of the applied bias voltage may be set to an appropriate optimum value depending on the properties of the toner, the process speed and the like.

According to the above-described configuration, it is possible to prevent the degradation of the device due to friction between the end portion of the film 20 and the regulating plate 30 by the presence of the driven ring 34, and to mitigate the strain between the film 20 and the driven ring 34 due to the distortion of the film 20 at the nip portion by the presence of the elastic member 33, and therefore to prevent the rupture or the damage of the end portion of the film and to mitigate the degradation of the film even when intending to increase the speed or the durability of the device. Furthermore, by applying a bias voltage, it is possible to prevent the generation of offset during the use of a long time period even in an environment of a low temperature and a low humidity, and to maintain an excellent image quality.

TABLE 2

| Number of sheets (thousands) | 50 | 100 | 150 | 200 | 250 | 300 | 350 |
|---|---|---|---|---|---|---|---|
| 2° (Comparative Example) | ND | D | — | — | — | — | — |
| Embodiment 7 | ND | ND | ND | ND | ND | ND | ND |
| 50° (Comparative Example) | ND | ND | D | — | — | — | — |

ND: the end portion not damaged
D: the end portion damaged

TABLE 3

| Number of sheets (thousands) | 50 | 100 | 150 | 200 | 250 | 300 | 350 |
|---|---|---|---|---|---|---|---|
| Embodiment 7 (−500V) | NO | NO | NO | NO | NO | NO | NO |
| Comparative Example (floating) | NO | NO | O | O | O | O | O |

Evaluation of offset
NO: no offset present
O: offset present

Although in the foregoing embodiments, a description has been provided of cases in which the present invention is applied to a fixing device, serving as an image heating device for heating a fixing film itself by eddy currents, the present invention is not limited to such an approach. For example, the present invention may also be applied to a fixing device serving as an image heating device in which a fixing film is made in contact with a heating unit provided separately from the fixing film and also operating as a guide for the fixing film, and the heat of the heating unit heated by eddy currents is transmitted to a material to be heated via the fixing film. Furthermore, the present invention may be applied, for example, to a fixing device, serving as an image heating device, in which a heat resistant film is made in sliding contact with a heating resistor, such as a ceramic heater or the like, and a pressing roller is made in pressure contact with the heat resistant film.

The individual components shown in outline in the drawings are all well known in the image heating device arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image heating device comprising:

an endless film for moving together with a recording material bearing an image while contacting the recording material;

a regulating member for regulating a shift of the film in a direction orthogonal to a moving direction of said film; and a protective member for protecting an end portion of said film in the direction orthogonal to the moving direction of said film, wherein said protective member has a hardness which is lower than that of said film.

2. A device according to claim 1, wherein said protective member comprises a cap for covering the end portion of said film.

3. A device according to claim 2, wherein said cap is ring-shaped.

4. A device according to claim 3, wherein said cap has a diameter gradually increasing toward said regulating member.

5. A device according to claim 1, wherein said protective member is provided on said regulating member.

6. A device according to claim 1, wherein said protective member has a hardness which is lower than that of said regulating member.

7. A device according to claim 1, wherein said protective member comprises POM.

8. A device according to claim 1, wherein said film comprises a conductive layer.

9. A device according to claim 8, further comprising magnetic-flux generation means for generating a magnetic flux, wherein eddy currents are generated in said film by the magnetic flux generated by said magnetic-flux generation means, and wherein said film generates a heat by the eddy currents to heat the image on the recording material.

10. A device according to claim 9, wherein said magnetic-flux generation means comprises an exciting coil and a core.

11. A device according to claim 8, wherein said protective member has a hardness which is lower than that of said conductive layer of said film.

12. A device according to claim 11, wherein said conductive layer comprises a nickel metal layer.

13. A device according to claim 1, further comprising a backup member for forming a nip with said film, wherein the recording material bearing the unfixed image is grasped and conveyed at said nip and the unfixed image on the recording material is fixed.

14. A device according to claim 1, wherein said protective member is provided on said film and rotates together with said film, when said film is shifted, said protective member contacts said regulating member.

15. A device according to claim 14, wherein said protective member is provided on a entire end portion of said film.

16. An image heating device comprising:

an endless film for moving together with a recording material bearing an image while contacting the recording material;

a regulating member for regulating a shift of said film in a direction orthogonal to a moving direction of said film;

a protective member for protecting an end portion of said film in the direction orthogonal to the moving direction of said film; and an elastic member provided between said film and said protective member.

17. A device according to claim 16, wherein said protective member comprises a cap for covering the end portion of said film.

18. A device according to claim 17, wherein said cap is ring shaped.

19. A device according to claim 16, wherein said elastic member comprises an elastic ring.

20. A device according to claim 16, wherein said protective member is provided on said film and rotates together with said film, when said film is shifted, said protective member contacts said regulating member.

21. A device according to claim 16, further comprising an adhesive member provided between said film and said elastic member.

22. A device according to claim 16, further comprising an adhesive member provided between said elastic member and said protective member.

23. A device according to claim 16, wherein said elastic member comprises an elastic adhesive.

24. A device according to claim 16, wherein said elastic member, said protective member and said regulating member are electrically conductive, and wherein said regulating member is grounded.

25. A device according to claim 24, wherein said film comprises an electrical conductive layer, and wherein said elastic member contacts said conductive layer of said film.

26. A device according to claim 16, wherein said elastic member is electrically insulating.

27. A device according to claim 26, wherein said film comprises an electrical conductive layer, and wherein a voltage is applied to said conductive layer of said film.

28. A device according to claim 16, further comprising magnetic-flux generation means for generating a magnetic flux, wherein eddy currents are generated in said film by the magnetic flux generated by said magnetic-flux generation means, and wherein said film generates heat by the eddy currents to heat the image on the recording material.

29. A device according to claim 28, wherein said magnetic-flux generation means comprises an exciting coil and a core.

30. A device according to claim 16, further comprising a backup member for forming a nip with said film, wherein the recording material bearing the unfixed image is grasped and conveyed at said nip and the unfixed image on the recording material is fixed.

31. An image heating device comprising:

an endless film for moving together with a recording material bearing an image while contacting the recording material;

a regulating member for regulating a shift of said film in a direction orthogonal to a moving direction of said film;

a protective member for protecting an end portion of said film in the direction orthogonal to the moving direction of said film; and an adhesive member provided between said film and said protective member.

32. A device according to claim 31, wherein said protective member has the shape of a ring, and rotates together with said film.

33. A device according to claim 31, wherein said adhesive member comprises a silicone adhesive.

34. A device according to claim 31, further comprising magnetic-flux generation means for generating a magnetic flux, wherein eddy currents are generated in said film by the magnetic flux generated by said magnetic-flux generation means, and wherein said film generates heat by the eddy currents to heat the image on the recording material.

35. A device according to claim 34, wherein said magnetic-flux generation means comprises an exciting coil and a core.

36. A device according to claim 31, further comprising a backup member for forming a nip with said film, wherein the recording material bearing the unfixed image is grasped and conveyed at said nip and the unfixed image on the recording material is fixed.

37. A device according to claim 31, wherein said protective member is provided on said film and rotates together with said film, when said film is shifted, said protective member contacts said regulating member.

38. A device according to claim 37, wherein said protective member is provided on a entire end portion of said film.

39. An image heating device comprising:

a rotating endless film having a metal layer;

magnetic-flux generation means for generating a magnetic flux, wherein eddy currents are generated in said film by the magnetic flux generated by said magnetic-flux generation means, and said film generates heat by the eddy currents to heat an image on a recording material;

a protective member being provided on an end portion of said film in a direction orthogonal to a moving direction of said film and rotating together with said film, for protecting the end portion of said film; and a regulating member for regulating a shift of said film in a direction orthogonal to the moving direction of said film, wherein when said film shifted, said protective member contacts said regulating member.

40. A device according to claim 39, wherein said protective member comprises a ring-shaped cap.

41. A device according to claim 39, wherein said magnetic-flux generation means comprises an exciting coil and a core.

42. A device according to claim 39, further comprising a backup member for forming a nip with said film, wherein the recording material bearing the unfixed image is grasped and conveyed at said nip and the unfixed image on the recording material is fixed.

43. A device according to claim 39, wherein said metal layer comprises a nickel metal layer.

44. A device according to claim 39, wherein said protective member is provided on an entire end portion of said film.

45. An image-heating, rotatable member comprising:

an endless film having a metal layer; and a protective member being provided on an end portion of said film in a direction orthogonal to a moving direction of said film and rotating together with said film, for protecting the end portion of said film.

46. A rotatable member according to claim 45, wherein said protective member comprises a ring-shaped cap.

47. A rotatable member according to claim 45, wherein said protective member comprises a resin.

48. A rotatable member according to claim 45, wherein said metal layer comprises a nickel metal layer.

49. A rotatable member according to claim 45, wherein said film comprises an elastic layer provided on said metal layer, and a releasing layer provided on said elastic layer.

50. A rotatable member according to claim 45, wherein said protective member is provided on an entire end portion of said film.

51. A rotatable member according to claim 45, wherein said protective member is provided on both end portions of said film.

52. A rotatable member according to claim 45, wherein said protective member contacts a regulating member for regulating a shaft of said rotatable member.

53. A rotatable member according to claim 45, wherein said rotatable member generates a heat by a magnetic flux generated by a magnetic-flux generating means, and said rotatable member heats an image on a recording material.

* * * * *

UNITED STATES PATENT AND TRADEMARK OFFICE

CERTIFICATE OF CORRECTION

PATENT NO. : 6,014,539

DATED : January 11, 2000

INVENTOR(S) : TETSUYA SANO, ET AL.

It is certified that error appears in the above-identified patent and that said Letters Patent is hereby corrected as shown below:

ON THE COVER PAGE

Insert:

[*] NOTICE: This patent issued on a continued prosecution application filed under 37 C.F.R. § 1.53(d) and is subject to the twenty year parent term provisions of 35 U.S.C. §154(a)(2).

COLUMN 1

Line 48, "causing" should read --causing a--.

COLUMN 2

Line 13, "film." should read --member.--.

UNITED STATES PATENT AND TRADEMARK OFFICE

CERTIFICATE OF CORRECTION

PATENT NO. : 6,014,539

DATED : January 11, 2000

INVENTOR(S) : TETSUYA SANO, ET AL.

It is certified that error appears in the above-identified patent and that said Letters Patent is hereby corrected as shown below:

COLUMN 6

Line 48, In Table 1, column "200", the second entry should be --D--.

COLUMN 9

Line 52, "pererably" should read --preferably--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*